US007288022B2

(12) United States Patent
Bacon et al.

(10) Patent No.: US 7,288,022 B2
(45) Date of Patent: Oct. 30, 2007

(54) WATER-DRIVEN TOOL

(76) Inventors: Robert Bacon, 5153 NW. 49th Ave., Coconut Creek, FL (US) 33073; Bruce Torrance, 1747 NE. 51 St., Pompano Beach, FL (US) 33064

( * ) Notice: Subject to any disclaimer, the term of this patent is extended or adjusted under 35 U.S.C. 154(b) by 307 days.

(21) Appl. No.: 11/128,531

(22) Filed: May 13, 2005

(65) Prior Publication Data

US 2006/0257246 A1 Nov. 16, 2006

(51) Int. Cl.
*B24B 23/02* (2006.01)

(52) U.S. Cl. ..... 451/295; 451/359

(58) Field of Classification Search ..... 451/295, 451/294, 359, 450

See application file for complete search history.

(56) References Cited

U.S. PATENT DOCUMENTS 1,698,970 A * 1/1929 Shaff ..... 451/359
1,881,129 A * 10/1932 Peek et al. ..... 15/29
2,077,693 A * 4/1937 Herrero ..... 451/358
4,102,084 A * 7/1978 Bloomquist ..... 451/357
4,193,228 A * 3/1980 Bowler ..... 451/359
6,203,415 B1 3/2001 Torrance-Castanza
6,669,876 B2 12/2003 Torrance

* cited by examiner

*Primary Examiner*—Robert A. Rose
(74) *Attorney, Agent, or Firm*—Alvin S. Blum

(57) ABSTRACT

A portable water-driven rotary tool for drilling, grinding and polishing concrete and stone that provides for high torque and that uses water pressures as the power source, the tool including a water control valve, an impeller with blades and a drive shaft that has a longitudinal axial water passage disposed therethrough for diverting water used to power the tool onto a work surface for lubrication and as a cleaning agent.

12 Claims, 3 Drawing Sheets

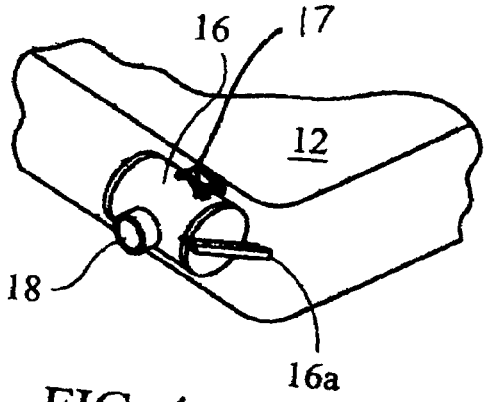
FIG. 4
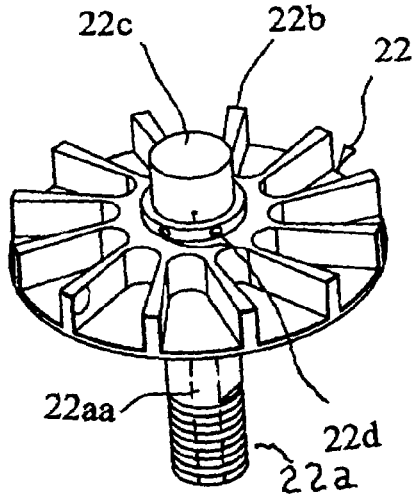
FIG. 6
FIG. 5
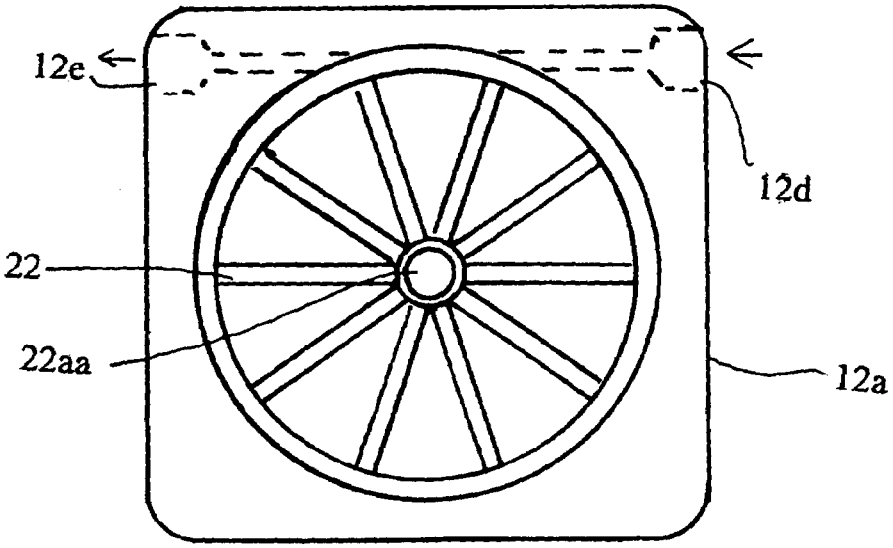

WATER-DRIVEN TOOL

BACKGROUND OF THE INVENTION

1. Field of the Invention

This invention relates generally to a water-driven rotary tool for drilling, cutting, shaping grinding, and polishing that uses water pressure to drive an impeller and includes a variable flow water valve that diverts water to the working surface through an axial opening in the impeller shaft.

2. Description of Related Art

The use of water-driven tools especially around concrete decks, pools and pool decks is known in the prior art. They sand, grind, and cut concrete surfaces and the like using high pressure water as the energy source by driving an impeller. Such tools are useful in a water or wet environment without concern for electrical injury. One of the advantages of a water-driven tool is that it can be used under water for grinding pool surfaces.

U.S. Pat. No. 6,203,415, issued to Torrance-Castanza et al. on Mar. 20, 2001, shows a direct drive water-driven rotary tool. Although the rotary tool shown in this patent provides moderate torque and can be used for multiple purposes, the tool does not provide for high torque or variable flow of the water directly to the work area.

SUMMARY OF THE INVENTION

The present invention provides for a very high torque, water-driven apparatus that includes a housing, a balanced counter-weighted impeller, axially opposed replaceable bearings, a shaft directly driven by the impeller, means for mounting a tool such as an abrasive mounting pad on the shaft. The invention provides a variable flow valve for controlling the volume of water flow through the apparatus and impeller shaft directly to the abrasive pad during operation for lubrication and cleaning purposes. Alternatively, fluid flows through a chuck mounted on the shaft to a tool such as a drill bit or a wire brush, for example. With a water flow control valve, the tool can provide variable-rpm, high torque in a very lightweight housing. The present invention also accommodates a more stable and variable grasp of the tool due to its shape.

A water-driven rotary apparatus for grinding and polishing surfaces such as in a pool, pool deck, or other concrete or stone slab that includes a compact, watertight housing having a cavity and an impeller that includes a plurality of counter balanced ribs or blades rotatably mounted in said housing cavity. A pressure water inlet conduit is in fluid communication with said housing cavity and said impeller blades. A water pressure outlet conduit is in fluid communication with said housing cavity. The impeller includes a center drive shaft, the end of which is provided with means for removably attaching tools such as a circular grinder pad for grinding or polishing of surfaces. The impeller drive shaft includes a water conduit axially disposed therethrough. The housing water outlet conduit is attached to a water control valve that can control and vary manually the water flow that exits the outlet from the housing cavity. If the water outlet conduit valve is closed or partially closed, more water in the housing cavity will be diverted to the impeller shaft internal conduit. The housing cavity water is forced out of the end of the impeller drive shaft onto the working surface through the center of the grinder or polisher pad attached at the end of the impeller drive shaft. Alternatively, other tools may be attached to the shaft, such as a chuck to receive a drill, for example.

Water under pressure enters the housing through the water inlet conduit. The water is received into the housing cavity and is directed to strike the impeller blades causing the impeller to rotate around a pair of bearings mounted on either side of the impeller in the housing. The impeller includes a central hub directly connected to the impeller blades and includes one or more water passages that are in fluid communication with the drive shaft inner water conduit. Water exits the shaft and passes through a central opening in the scrubbing or abrasive disk attached to the shaft to impinge on the work piece where it is centrifugally forced across the work piece. This action continuously flushes the work surface of freed material, greatly enhancing the operation.

The water outlet valve is variable between fully closed and fully opened positions thereby providing for a variable water flow and variable torque and rpm of the impeller and drive shaft. The exterior surface of the housing includes a plurality of raised concave surfaces that project outwardly on one side of the housing that can receive the fingers and thumb of the user for easier grasping of the tool during operation.

The rotary apparatus includes a pair of bearings that are connected operationally to either side of the impeller and fit tightly into recesses on the interior walls of the housing cavity.

The impeller blades are radially disposed from a central hub at pre-determined radial angles and varied degree of counterweight for more efficient operation to achieve maximum inertia as the water stream is directed against the impeller blade surfaces during operation and rotation.

The water flow control valve is connected to the outlet of the housing water outlet conduit and itself may include an additional flexible conduit that can be manually turned and varied in direction so that the exhaust water can be directed in a particular direction relative to the housing.

A water control valve may also be provided before the water inlet conduit as well.

The housing may be constructed from two separate metal or plastic plates that are fastened together with the internal cavity being substantially cylindrical.

It is an object of this invention to provide a direct drive, water-driven, rotary apparatus for grinding and polishing pool and deck surfaces of cement, natural stone, and the like that produces high torque and variable water flow control as a power source.

It is another object of this invention to provide a rotary, water-driven apparatus that includes an impeller that has a drive shaft with an axial internal passage that can provide water directly to the work surface through the center of a spinning tool for centrifugal water flushing during operation.

Yet another object of the invention is to provide a water-driven rotary apparatus with a variable flow valve that permits control of the rpm and torque for grinding, polishing, cutting, and shaping materials.

In accordance with these and other objects, which will become apparent hereinafter, the instant invention will now be described with particular reference to the accompanying drawings.

BRIEF DESCRIPTION OF THE DRAWINGS

FIG. 4 shows a perspective view of a variable flow control valve with the housing partially cut away.

FIG. 5 shows a front elevational view of the inside of the housing with the impeller in place and the inlet and outlet water passages dotted.

FIG. 6 shows a perspective view of the impeller and drive shaft with the internal water passage dotted.

DETAILED DESCRIPTION OF PREFERRED EMBODIMENT

Figure 1:
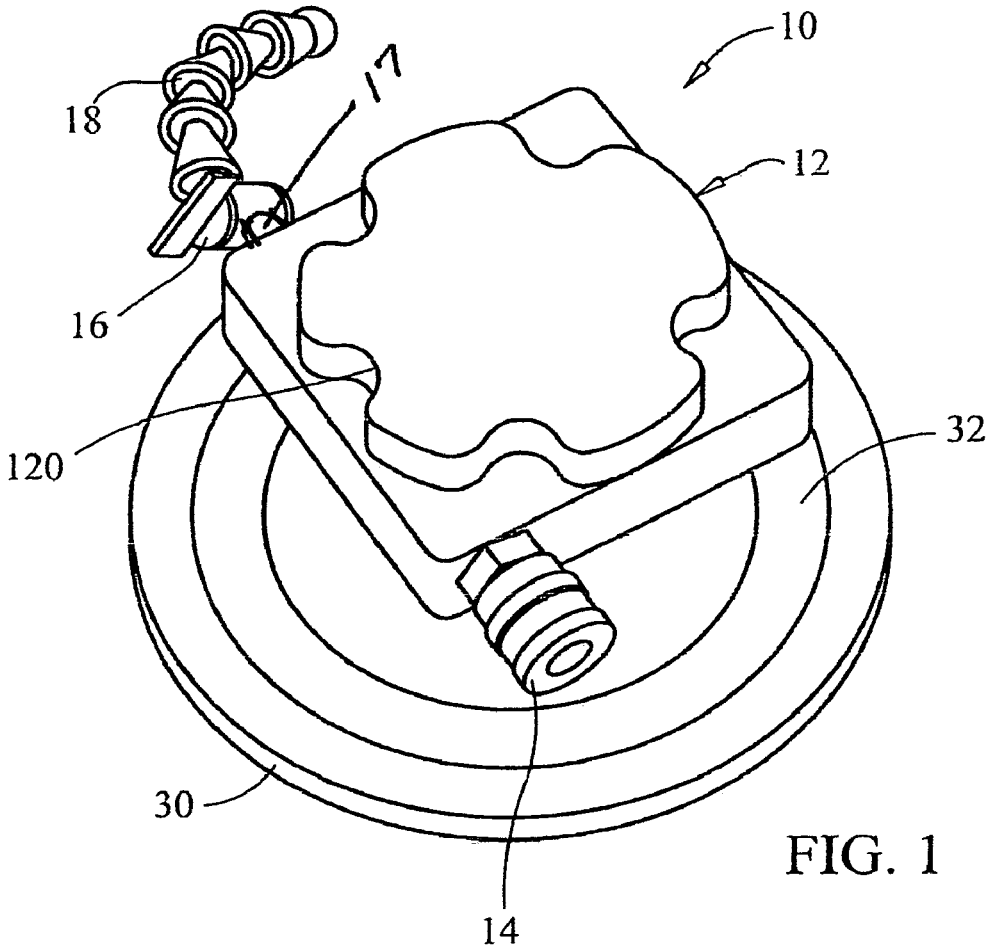
FIG. 1 shows a front perspective view of the present invention with a grinding disk.
Figure 2:
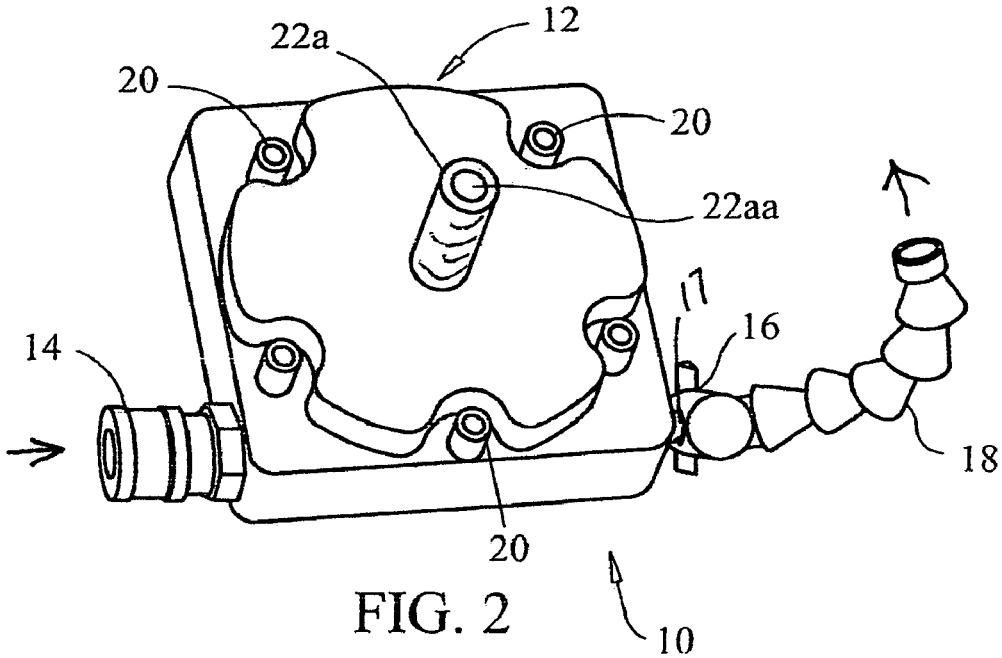
FIG. 2 shows a back perspective view of the invention without the grinding disk.

Referring now to the drawings and, in particular, FIG. 1 and FIG. 2, water driven rotary apparatus of the present invention is shown generally at 10. It includes a watertight metal or plastic housing 12, a water inlet conduit 14 that attaches to a pressure water source (not shown), a housing water outlet conduit 17 and manual water control valve 16 that is in fluid communication with water outlet nozzle 18. In FIG. 1, the front of housing 12 includes a plurality of concave recessed wall portions 120 to receive the user's fingers for holding the apparatus 10 in place during operation. A grinder or polisher disk 32 is removably attached to drive shaft 22*a* and includes a replaceable grinding surface 30 that is used to grind or polish stone, or cementitious surfaces, for example.

FIG. 2 shows a plurality of fasteners 20 that hold the two-piece housing 12 together. The rotatable drive shaft 22*a* is shown as it exits housing 12. The drive shaft 22*a* includes an axial interior water passage or conduit 22*aa* that allows water in the housing cavity to flow out to the center of the grinder, polisher, or other tool removably attached to the shaft. Water emitted from the center of the tool directly onto the work surface acts as a lubricant or cleaning agent during operation, as the water is forcefully moved by centrifugal action across the surface being worked.

A manually actuated inlet valve, which is not shown, can be attached to the inlet conduit 14 to control the operation of the tool by varying the amount of inlet water from the pressure source (not shown). The manually operated water flow control valve 16 can be rotated between fully closed in which no water can flow out of the housing through outlet nozzle 18 and fully open in which most of the water in the housing that enters through inlet 14 is expelled through outlet nozzle 18. The control valve 16 can also be adjusted to intermediate flow positions so that a portion of the water flows out of outlet nozzle 18 and a portion of movable positionable segments to direct the exhaust flow of water in a desired direction towards the work surface during operation. The highest torque is achieved when the control valve 16 is fully open.

Figure 3:
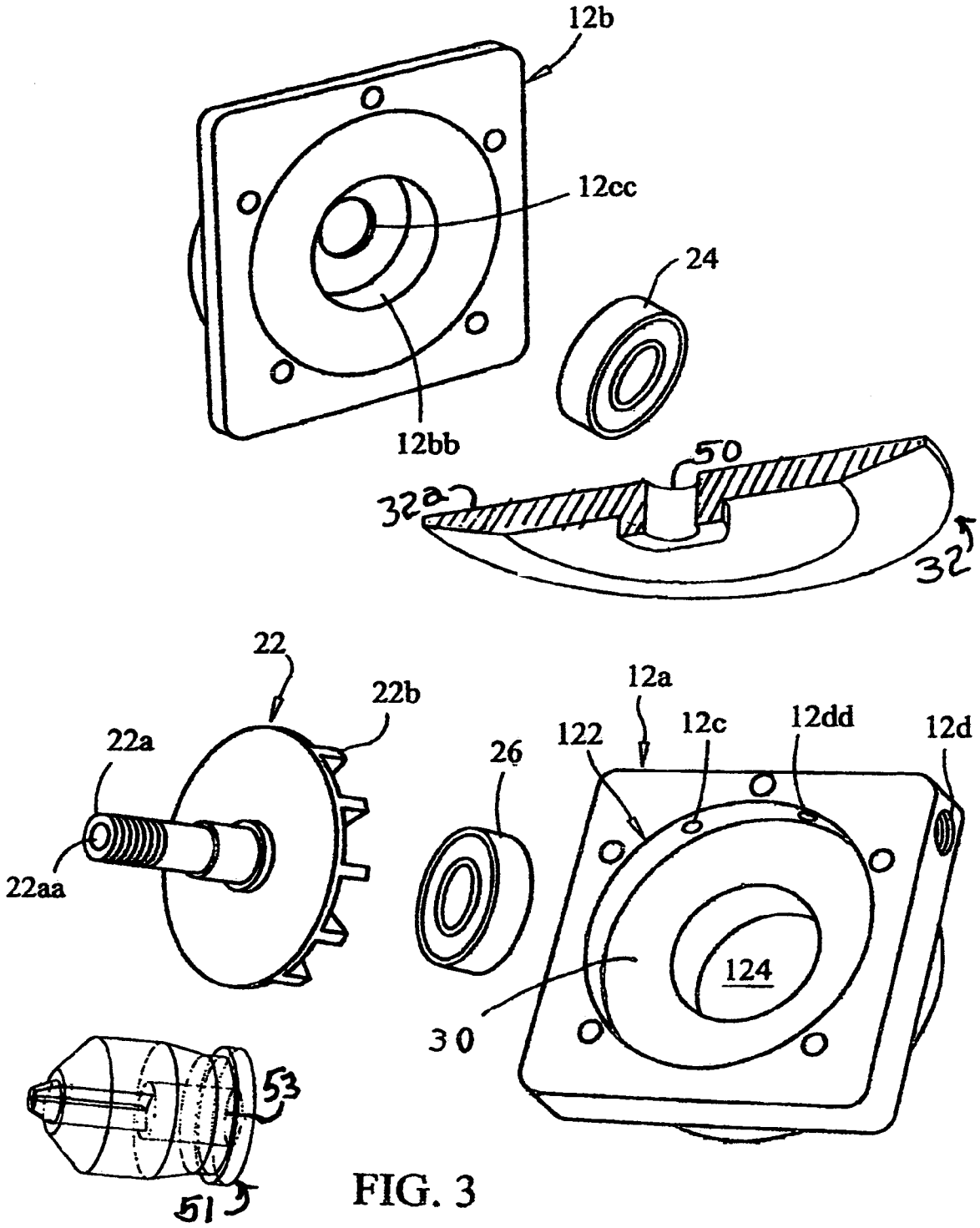
FIG. 3 shows an exploded view of the invention front and back with accessories.

Referring now to FIG. 3, the housing is shown in two pieces 12*a* and 12*b* which can be fastened together as described with reference to FIG. 1. Housing 12*b* is a rigid piece of metal or plastic that has a recessed cylindrical portion 12*bb* that receives a watertight bearing 24 and a circular hole 12*cc* which receives the drive shaft 22*a*. A disc 32, shown partially cut away, with abrasive or polishing surface 32*a* having a central hole 50 may be mounted on the drive shaft. Another tool that may be mounted on the drive shaft, for example, is a drill chuck 51 having a central passage 53 therethrough.

Housing portion 12*a* is a rigid piece of metal that includes an inlet aperture 12*d* that includes threads that attaches to an inlet conduit for a pressure water supply (not shown). The inlet aperture 12*d* is fluid communication with internal housing passage 12*dd* so that there is fluid communication of aperture 12*d* into inside cavity 30 formed by circular wall 122 which receives the impeller 22 and impeller blades 22*b*. An external outlet internal passage for water 12*c* also terminates in fluid communication with an outlet conduit 17 connected to the control valve 16 as shown in FIG. 1. A cylindrical recess portion 124 receives watertight bearing 26 which attaches to a hub 22*c* on the impeller 22, as shown in FIG. 6.

The impeller 22 includes a drive shaft 22*a* that is formed with the impeller including impeller blades 22*b* that are formed as one unit. The drive shaft 22*a* includes an internal passage forming a water conduit 22*aa* that passes all the way through the drive shaft and through holes in a hub described below.

Thus, in operation, the housing walls 12*a* and 12*b* are fastened securely together in a water tight seal with the impeller 22 mounted inside cavity 122 and the drive shaft 22*a* protruding out through opening 12*cc* in housing wall 12*b* FIG. 4 shows the manually actuated water control valve 16 attached to the housing 12 through outlet conduit 17 and to the outlet water nozzle 18. Manipulation of the control valve handle 16*a* by rotation will allow the valve to be moved between open, closed or variable flow or some point in between. Thus, the volume of water coming out of outlet conduit 18 can be controlled from zero to a predetermined maximum and to some flow volume in between. When the valve 16 is completely open, the tool has maximum torque.

FIG. 5 shows housing wall 12*a* with the impeller blades 22*a* shown relative to housing inlet passage 12*d* and outlet passage 12*e* which are dotted to show the flow of water in and out of the housing wall 12*a*. The passages 12*d* and 12*e* are formed so that the stream of water entering through 12*d* will pass into the housing cavity through opening 12*dd* to strike the impeller blades 22*a* forcing the impeller to rotate. The flow of water continues through passage 12*e* and out of the housing. This path of water provides for high torque with direct drive from the inlet water stream to the impeller blades and then to the outlet passage for the water. The torque will be related to the inlet pressure. This may vary from household pressure of 45 p.s.i. to thousands of p.s.i. The drive shaft conduit outlet 22*aa*, which allows water to flow by adjusting control valve 16, is also shown in FIG. 5. As the control valve 16 is closed, more water pressure will flow out of passage 22*aa* and through central hole 50 and onto the work surface.

Referring now to FIG. 6, the unitary impeller is shown that includes a plurality of impeller blades 22*b* radially disposed around a hub 22*c* that includes a transverse aperture 22*d* that is in fluid communication with the drive shaft 22*a* and, specifically, with the drive shaft conduit 22*aa*, which runs the full length of drive shaft 22*a*, terminating in an opening outside the housing, as shown in FIG. 2. The drive shaft conduit 22*aa* allows water to flow into opening 22*d* where the water is then dispersed and dispensed onto the work surface during operation of the device. There are multiple water holes 22*d* disposed around the hub (shown) and/or in the root of the blades 22*c* (not shown), all of which are in fluid communication with the drive shaft conduit 22*aa*.

The rotary apparatus may be held by manually grasping the outer surface shown in FIG. 1 with the fingers and thumb of one hand engaged in and around concave recesses 120. The control valve 16 will be set as desired by the user to either open to expel all the water from outlet nozzle 18 (high torque) or divert more of the water out through the drive shaft conduit 22*aa* by closing valve 16. An inlet valve, not shown, is connected to the inlet conduit 14 to control the flow of water into the device. The disk 32 and grinder or polisher surface 30 with center hole 50 is attached to drive shaft 22*a* by conventional device well known in the art. The rotating shaft rotates disk 32 and a sanding or grinding surface 30, with some water going out through hole 50. In another mode of operation, the control valve 16 can be fully closed so that no water escapes through outlet nozzle 18. In this mode of operation, all of the inlet water will then exit through drive shaft conduit 22*aa*.

Using the present invention, water that drives the tool can be used also as a lubricant or a cleaning agent on the work surface by diverting water flow through the drive shaft, which allows for hydroplaning of the abrasive pad for optimum operation. The variable flow valve 16 can also be used to control rpm and torque of the device. The apparatus is made of metal or plastic and delivers high torque for grinding and polishing many different types of surfaces. The bearings may be formed from a portion of the housing, if desired. The impeller and shaft may be made separately and joined together, or they may be made in one piece, if desired.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A water-driven apparatus for rotating a tool that uses pressurized water as a power source comprising:

a watertight housing having a cavity;

an impeller having a plurality of blades rotatably mounted in said housing cavity;

a water inlet conduit connected to said housing and in fluid communication with said housing cavity and said impeller blades;

a water outlet conduit connected to said housing and in fluid communication with said housing cavity;

a drive shaft affixed to said impeller, said drive shaft having an axial internal water passage with a terminal opening outside said housing;

at least one transverse channel in said impeller, said at lest one transverse channel in fluid communication with said housing cavity at a first end and in fluid communication with said axial internal water passage at a second end;

means for removably attaching a tool to said drive shaft;

said housing having a first wall, with an inside surface, the inside surface partially defining in said housing cavity;

a first bearing mounted in said first wall, said drive shaft and impeller rotatably supported by said first bearing;

said housing having a second wall, with an inside surface, the inside surface partially defining in said housing cavity; and a second bearing mounted in said second wall, said drive shaft and impeller rotatably supported by said second bearing.

2. The apparatus according to claim 1 further comprising a water flow control valve connected to said water outlet conduit to adjust the flow of water flowing from said outlet conduit, and thereby diverting water through the terminal opening in the drive shaft.

3. The apparatus according to claim 2 further comprising a disk with a central opening removably connected to said shaft.

4. The apparatus according to claim 1 further comprising a disk with a central opening removably connected to said shaft.

5. The apparatus according to claim 1 further comprising a chuck with an axial opening removably connected to said shaft.

6. The apparatus according to claim 2 further comprising a chuck with an axial opening removably connected to said shaft.

7. A water-driven apparatus for rotating a tool that uses pressurized water as a power source comprising:

a watertight housing having a cavity;

an impeller having a plurality of blades rotatably mounted in said housing cavity;

a water inlet conduit connected to said housing and in fluid communication with said housing cavity and said impeller blades;

a water outlet conduit connected to said housing and in fluid communication with said housing cavity;

a drive shaft affixed to said impeller, said drive shaft having an axial internal rotary water passage with a terminal opening outside said housing;

at least one channel in said impeller in fluid communication with said housing cavity at a first end and in fluid communication at a second end inside said housing with said axial internal water passage; and means for removably attaching a tool to said drive shaft.

8. The apparatus according to claim 7 further comprising a water flow control valve connected to said water pressure outlet conduit to adjust the flow of water flowing from said outlet conduit, and thereby diverting more water through the terminal opening in the drive shaft.

9. The apparatus according to claim 8 further comprising a disk with a central opening removably connected to said shaft.

10. The apparatus according to claim 7 further comprising a disk with a central opening removably connected to said shaft.

11. The apparatus according to claim 7 further comprising a chuck with an axial opening removably connected to said shaft.

12. The apparatus according to claim 8 further comprising a chuck with an axial opening removably connected to said shaft.

* * * * *